US011564538B2

(12) United States Patent
Hand et al.

(10) Patent No.: US 11,564,538 B2
(45) Date of Patent: Jan. 31, 2023

(54) HINGE POST FOR TOILET SEAT

(71) Applicant: Bemis Manufacturing Company, Sheboygan Falls, WI (US)

(72) Inventors: Joseph M. Hand, Sheboygan Falls, WI (US); Jonathan Arndt, Sheboygan, WI (US)

(73) Assignee: BEMIS MANUFACTURING COMPANY, Sheboygan Falls, WI (US)

( * ) Notice: Subject to any disclaimer, the term of this patent is extended or adjusted under 35 U.S.C. 154(b) by 90 days.

(21) Appl. No.: 17/072,383

(22) Filed: Oct. 16, 2020

(65) Prior Publication Data

US 2021/0113035 A1 Apr. 22, 2021

Related U.S. Application Data

(60) Provisional application No. 62/923,951, filed on Oct. 21, 2019.

(51) Int. Cl.
*A47K 13/26* (2006.01)
*A47K 13/12* (2006.01)

(52) U.S. Cl.
CPC ..... *A47K 13/26* (2013.01); *A47K 13/12* (2013.01)

(58) Field of Classification Search
CPC ..... A47K 13/12; A47K 13/26
USPC ..... 4/236
See application file for complete search history.

(56) References Cited

U.S. PATENT DOCUMENTS 3,781,924 A 1/1974 Davis, Jr.
4,616,737 A 10/1986 Orii
4,766,619 A 8/1988 Takeda
4,938,322 A 7/1990 Sugasawara et al.
4,984,666 A 1/1991 Orii et al.
5,010,601 A 4/1991 Kobayashi et al.
5,079,797 A 1/1992 Ohshima et al.
5,090,521 A 2/1992 Miura
5,109,571 A 5/1992 Ohshima et al.
5,111,548 A 5/1992 Ohshima
5,135,083 A 8/1992 Hayashi et al.
5,142,740 A 9/1992 Amaki et al.
5,152,189 A 10/1992 Miura et al.
5,153,946 A 10/1992 Yoke et al.
(Continued)

FOREIGN PATENT DOCUMENTS

CN 108420353 A 8/2018
FR 1093165 A 5/1955

OTHER PUBLICATIONS

Extended European Search Report for Application No. 20202648.0 dated Mar. 11, 2021 (8 pages).
(Continued)

*Primary Examiner* — Christine J Skubinna
(74) *Attorney, Agent, or Firm* — Michael Best & Friedrich LLP

(57) ABSTRACT

A toilet seat assembly includes a hinge post configured to be coupled to a toilet bowl, a toilet seat configured to move between a raised position and a lowered position about a pivot axis relative to the toilet bowl, and a slow-close member coupled between the hinge post and the toilet seat such that the toilet seat is moveable along a second axis relative to the hinge post. The slow-close member controls movement of the toilet seat about the pivot axis when the toilet seat moves from the raised position to the lowered position.

15 Claims, 9 Drawing Sheets

(56) References Cited

U.S. PATENT DOCUMENTS

| | | | |
|---|---|---|---|
| 5,165,507 | A | 11/1992 | Ohshima |
| 5,175,891 | A | 1/1993 | Ohshima et al. |
| 5,193,228 | A | 3/1993 | Murasawa et al. |
| 5,193,230 | A | 3/1993 | Guerty |
| 5,211,269 | A | 5/1993 | Ohshima |
| 5,255,396 | A | 10/1993 | Miyahara et al. |
| 5,257,852 | A | 11/1993 | Tsuneki et al. |
| 5,267,356 | A | 12/1993 | Gideon et al. |
| 5,276,945 | A | 1/1994 | Matsumura |
| 5,279,000 | A | 1/1994 | Mercier et al. |
| 5,309,624 | A | 5/1994 | Nishikawa |
| 5,343,571 | A | 9/1994 | Guerty |
| 5,353,899 | A | 10/1994 | Ohshima |
| 5,388,281 | A | 2/1995 | Wiklund et al. |
| 5,390,770 | A | 2/1995 | Miyahara et al. |
| 5,398,610 | A | 3/1995 | Pavliny et al. |
| 5,419,013 | A | 5/1995 | Hsiao |
| 5,530,993 | A | 7/1996 | Hayakawa |
| 5,537,086 | A | 7/1996 | Noritake |
| 5,604,936 | A | 2/1997 | Mausolf |
| 5,664,286 | A | 9/1997 | Sorimachi |
| 5,697,122 | A | 12/1997 | Okabe et al. |
| 5,720,370 | A | 2/1998 | Takahashi |
| 5,724,683 | A | 3/1998 | Sorimachi et al. |
| 5,742,949 | A | 4/1998 | Goldi et al. |
| 5,768,718 | A | 6/1998 | Sorimachi |
| 5,769,188 | A | 6/1998 | Okabe et al. |
| 5,842,235 | A | 12/1998 | Miyazaki |
| 5,875,874 | A | 3/1999 | Okabe et al. |
| 5,876,014 | A | 3/1999 | Noritake et al. |
| 5,878,444 | A | 3/1999 | Convoy |
| 5,884,342 | A | 3/1999 | Maake |
| 5,901,383 | A | 5/1999 | Yanagawa et al. |
| 5,904,411 | A | 5/1999 | Hayakawa |
| 5,906,010 | A | 5/1999 | Suzuki |
| 5,918,322 | A | 7/1999 | Yamamoto et al. |
| 5,946,740 | A | 9/1999 | Sorimachi |
| 5,971,514 | A | 10/1999 | Hayakawa |
| 5,974,595 | A | 11/1999 | McCabe |
| 5,991,936 | A | 11/1999 | Sorimachi |
| 5,996,132 | A | 12/1999 | Sorimachi |
| 6,000,069 | A | 12/1999 | Sorimachi |
| 6,009,568 | A | 1/2000 | Miyazaki |
| 6,026,520 | A | 2/2000 | Pedersen |
| 6,035,454 | A | 3/2000 | Birchall |
| 6,052,869 | A | 4/2000 | Suzuki |
| 6,058,726 | A | 5/2000 | Noritake |
| 6,067,667 | A | 5/2000 | Suzuki |
| 6,069,466 | A | 5/2000 | Noritake et al. |
| 6,119,310 | A | 9/2000 | Ohshima et al. |
| 6,121,526 | A | 9/2000 | Kobori et al. |
| 6,178,597 | B1 | 1/2001 | Suzuki et al. |
| 6,182,301 | B1 | 2/2001 | Krueger et al. |
| 6,213,881 | B1 | 4/2001 | Sasa et al. |
| 6,215,217 | B1 | 4/2001 | Kurosawa |
| 6,244,564 | B1 | 6/2001 | Noritake |
| 6,275,999 | B1 | 8/2001 | Fujita |
| 6,305,050 | B1 | 10/2001 | Imai |
| 6,330,891 | B1 | 12/2001 | Noritake |
| 6,336,252 | B1 | 1/2002 | Bando |
| 6,389,611 | B2 | 5/2002 | Fujita |
| 6,390,255 | B2 | 5/2002 | Kobori et al. |
| 6,393,624 | B1 | 5/2002 | Iwashita |
| 6,421,842 | B1 | 7/2002 | Fujita |
| 6,473,936 | B2 | 11/2002 | Orita |
| 6,523,185 | B1 | 2/2003 | Moore et al. |
| 6,523,224 | B1 | 2/2003 | Oshima et al. |
| 6,543,066 | B2 | 4/2003 | Tomita et al. |
| 6,543,088 | B2 | 4/2003 | Koshikawa |
| 6,550,073 | B2 | 4/2003 | Hellwig et al. |
| 6,587,676 | B1 | 7/2003 | Oshima et al. |
| 6,588,063 | B2 | 7/2003 | Oshima et al. |
| 6,601,269 | B2 | 8/2003 | Oshima et al. |
| 6,634,033 | B2 | 10/2003 | Mizuno et al. |
| 6,687,921 | B1 | 2/2004 | Li |
| 6,704,418 | B1 | 3/2004 | Koshikawa |
| 6,725,984 | B2 | 4/2004 | Orita |
| 6,729,447 | B2 | 5/2004 | Takahashi |
| 6,729,448 | B2 | 5/2004 | Takahashi |
| 6,769,520 | B2 | 8/2004 | Namiki et al. |
| 6,772,481 | B2 | 8/2004 | Oshima et al. |
| 6,775,854 | B2 | 8/2004 | Nishikawa et al. |
| 6,785,936 | B2 | 9/2004 | Koshikawa |
| 6,789,292 | B2 | 9/2004 | Oshima et al. |
| 6,840,355 | B2 | 1/2005 | Iwashita |
| 6,840,356 | B2 | 1/2005 | Nishiyama |
| 10,292,658 | B2 | 5/2019 | Borkholder et al. |
| 2001/0000887 | A1 | 5/2001 | Gustafsson et al. |
| 2001/0004776 | A1 | 6/2001 | Fujita |
| 2001/0014993 | A1 | 8/2001 | Orita |
| 2002/0007993 | A1 | 1/2002 | Kobori et al. |
| 2002/0043127 | A1 | 4/2002 | Takahashi |
| 2002/0062518 | A1 | 5/2002 | Hellwig et al. |
| 2002/0083555 | A1 | 7/2002 | Suzuki |
| 2002/0179387 | A1 | 12/2002 | Orita |
| 2003/0009819 | A1 | 1/2003 | Mizuno et al. |
| 2003/0075404 | A1 | 4/2003 | Takahashi |
| 2003/0126717 | A1 | 7/2003 | Iwashita |
| 2003/0155196 | A1 | 8/2003 | Nishiyama |
| 2003/0159736 | A1 | 8/2003 | Noritake |
| 2003/0234145 | A1 | 12/2003 | Iwashita |
| 2004/0000655 | A1 | 1/2004 | Noritake |
| 2004/0147219 | A1 | 7/2004 | Noritake |
| 2004/0159809 | A1 | 8/2004 | Noritake et al. |
| 2004/0244849 | A1 | 12/2004 | Iwashita et al. |
| 2016/0015226 | A1* | 1/2016 | Chen ..... A47K 13/06 4/235 |
| 2020/0370352 | A1* | 11/2020 | Pecar ..... F16F 9/14 |

OTHER PUBLICATIONS

European Patent Office Action for Application No. 20202648.0 dated Apr. 1, 2022 (6 pages).

* cited by examiner

HINGE POST FOR TOILET SEAT

CROSS-REFERENCE TO RELATED APPLICATION

This application claims the benefit of U.S. Provisional Patent Application No. 62/923,951 filed Oct. 21, 2019, the contents of which are incorporated herein by reference.

FIELD OF THE DISCLOSURE

The present disclosure relates to hinge posts that couple a toilet seat to a toilet bowl and, more particularly, to slow-close hinge posts for the toilet seat.

SUMMARY

In one aspect, a toilet seat assembly includes a hinge post configured to be coupled to a toilet bowl, a toilet seat configured to move between a raised position and a lowered position about a pivot axis relative to the toilet bowl, and a slow-close member coupled to the hinge post such that the pivot axis remains stationary relative to the hinge post. The slow-close member is also coupled to the toilet seat such that the toilet seat is moveable along a second axis relative to the hinge post. The slow-close member controls movement of the toilet seat about the pivot axis when the toilet seat moves from the raised position to the lowered position.

In another aspect, a toilet seat assembly includes a hinge post configured to be coupled to a toilet bowl, a toilet seat configured to move between a raised position and a lowered position about a pivot axis relative to the toilet bowl, and a slow-close member coupled to the hinge post such that the pivot axis is moveable along a second axis relative to the hinge post. The slow-close member is also coupled to the toilet seat to control movement of the toilet seat about the pivot axis when the toilet seat moves from the raised position to the lowered position.

In yet another aspect, a toilet seat assembly includes a hinge post configured to be coupled to a toilet bowl, a toilet seat configured to move between a raised position and a lowered position about a pivot axis relative to the toilet bowl, and a slow-close member coupled between the hinge post and the toilet seat such that the toilet seat is moveable along a second axis relative to the hinge post. The slow-close member controls movement of the toilet seat about the pivot axis when the toilet seat moves from the raised position to the lowered position.

In addition, other aspects of the disclosure will become apparent by consideration of the detailed description and accompanying drawings.

DETAILED DESCRIPTION

Before any embodiments of the disclosure are explained in detail, it is to be understood that the disclosure is not limited in its application to the details of construction and the arrangement of components set forth in the following description or illustrated in the following drawings. The disclosure is capable of other embodiments and being practiced or being carried out in various ways. Also, it is to be understood that the phraseology and terminology used herein is for the purpose of description and should not be regarded as limiting. Terms of degree, such as "substantially," "about," "approximately," etc. are understood by those of ordinary skill to refer to reasonable ranges outside of the given value, for example, general tolerances associated with manufacturing, assembly, and use of the described embodiments.

Figure 1:
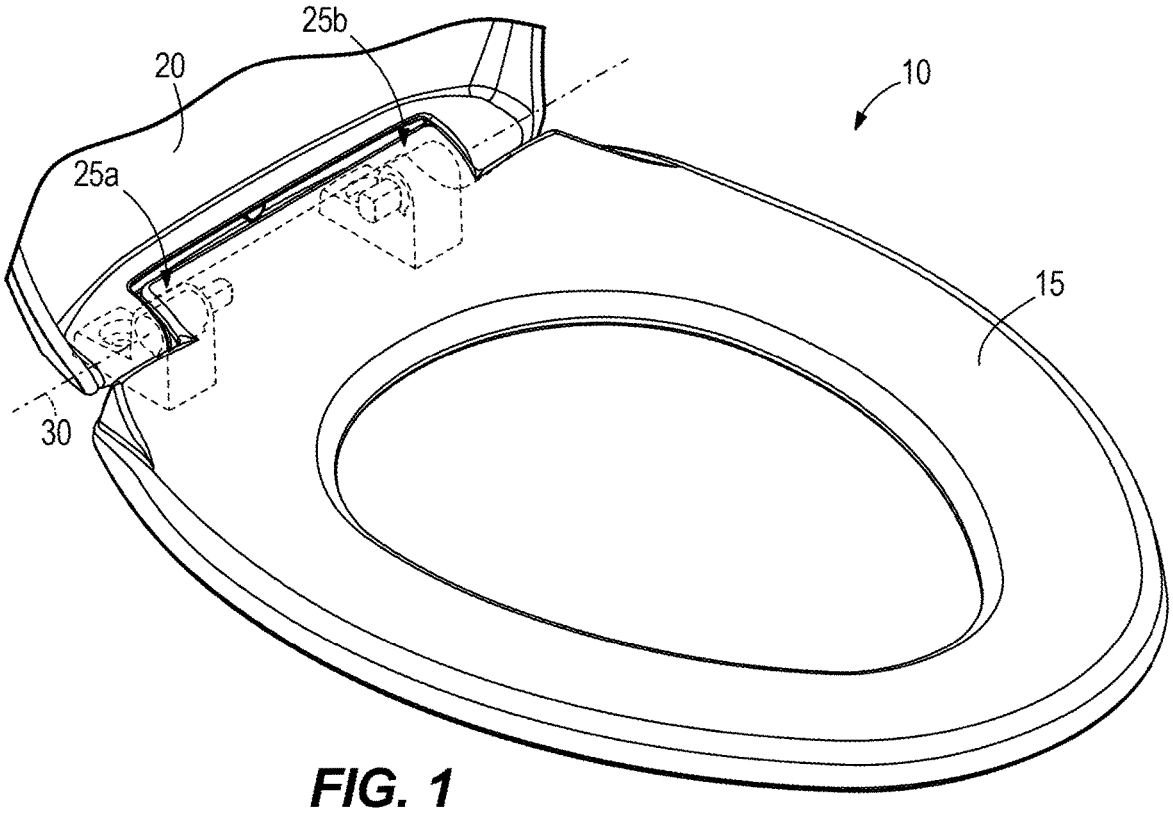
FIG. 1 is a perspective view of a toilet seat assembly including a toilet seat and a toilet lid pivotably coupled to hinge posts according to one embodiment.
Figure 3:
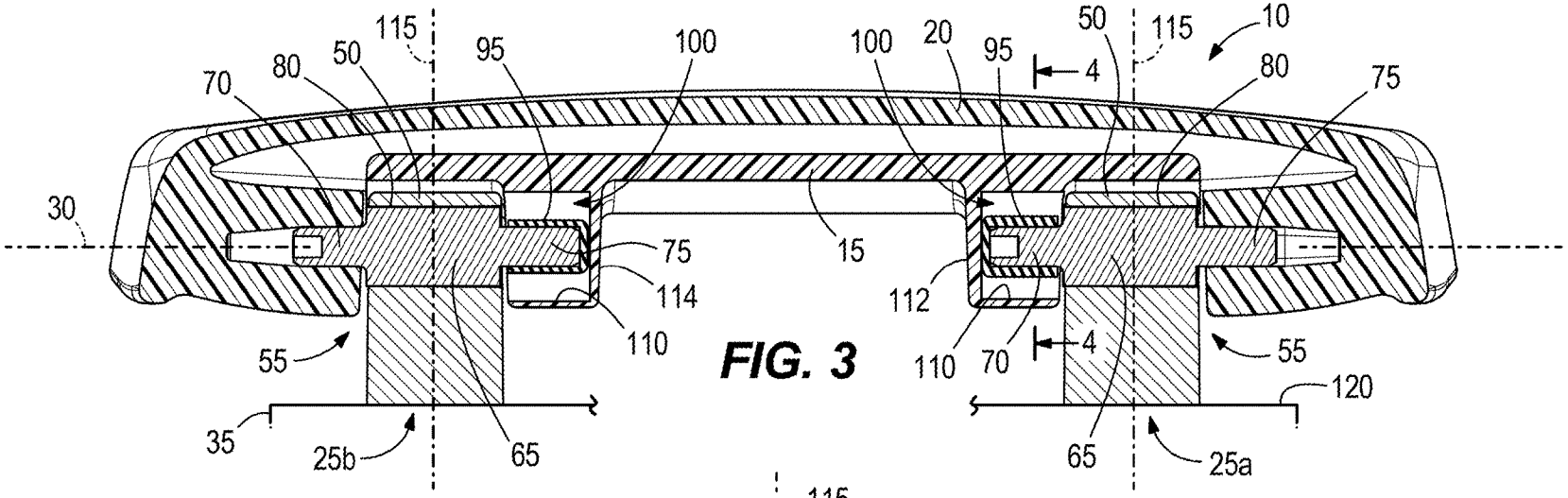
FIG. 3 is a cross sectional view of the toilet seat assembly of FIG. 1 taken along a pivot axis of the toilet seat when the toilet seat is in a lowered position and the toilet lid is in a closed position.
Figure 4:
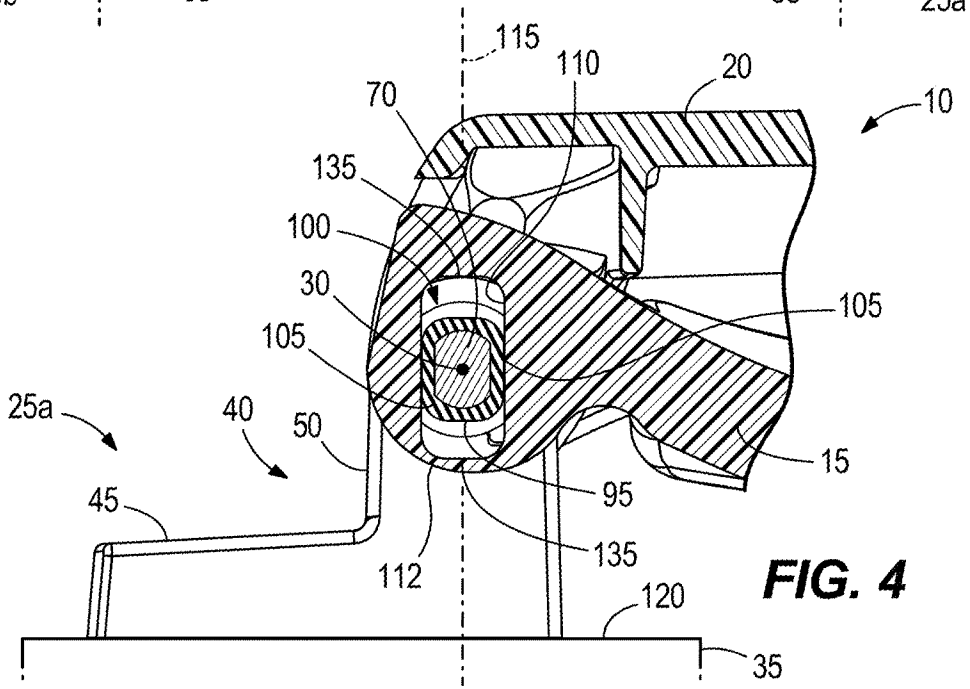
FIG. 4 is a cross sectional view taken along line 4-4 of FIG. 3.

FIG. 1 illustrates a toilet seat assembly 10 including a toilet seat 15 and a toilet lid 20 pivotably coupled to two hinge posts 25*a*, 25*b* about a pivot axis 30. The hinge posts 25*a*, 25*b* may also be referred to as floating hinge posts or no-load hinge posts, as further explained below. The hinge posts 25*a*, 25*b* are selectively fixed to a toilet bowl 35 (FIGS. 3-5) with the toilet seat 15 and the toilet lid 20 independently moveable about the pivot axis 30 relative to the toilet bowl 35. Specifically, the toilet seat 15 is pivotable between a raised position and a lowered position (FIGS. 1 and 3-5), and the toilet lid 20 is pivotable between an open position (FIGS. 1 and 5) and a closed position (FIGS. 3 and 4). In other embodiments, the toilet seat assembly 10 can include one floating hinge post to which the toilet seat 15 and the toilet lid 20 are pivotably coupled.

Figure 2:
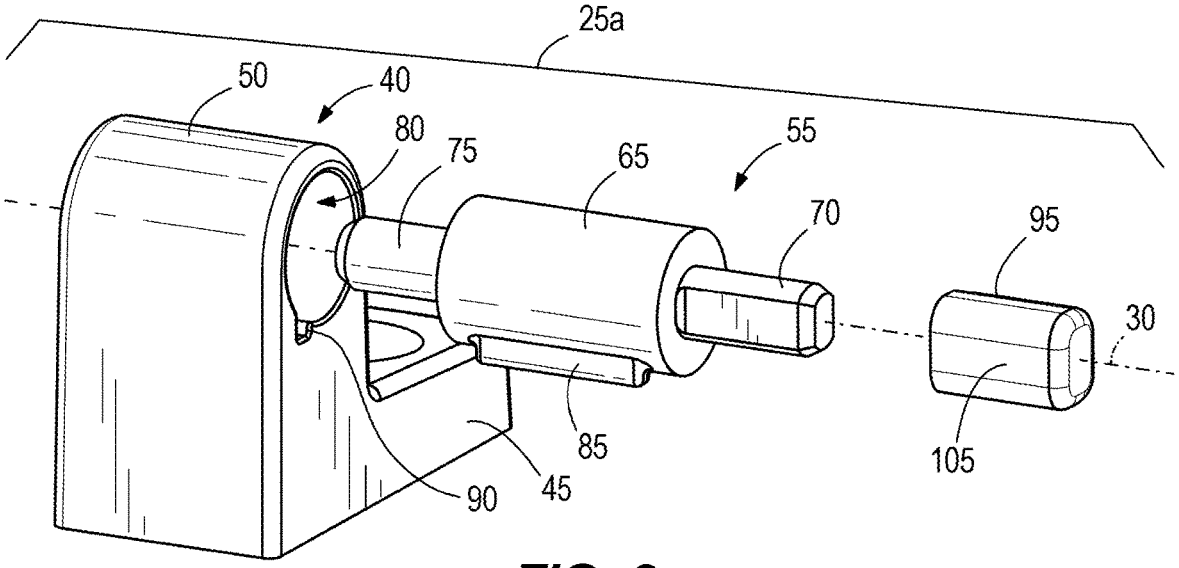
FIG. 2 is an exploded view of one hinge post of FIG. 1.

The first hinge post 25*a* is illustrated in FIG. 2 and described below, but features of the first hinge post 25*a* are equally applicable to the second hinge post 25*b*. The illustrated hinge post 25*a* includes a body 40 having a mounting portion 45 that couples the first hinge post 25*a* to the toilet bowl 35 (e.g., by a fastener, a quick-disconnect mechanism, etc.) and an upright portion 50. A slow-close mechanism or member 55 is coupled to the upright portion 50 and includes a damper 65 with a first shaft 70 and a second shaft 75 extending away from each other on opposite sides of the damper 65 and rotatably coupled to the damper 65. The damper 65 defines the pivot axis 30 with the first shaft 70 and the second shaft 75 concentric with the pivot axis 30. The illustrated damper 65 is received within a bore 80 of the upright portion 50. The damper 65 includes a tab 85 that engages a notch 90 of the bore 80 to inhibit rotation of the damper 65 about the pivot axis 30 relative to the upright portion 50. In addition, the damper 65 is constrained within the upright portion such that the pivot axis 30 is fixed relative to the body 40. In other embodiments, engagement between the damper 65 and the upright portion 50 (e.g., a keyed arrangement) can be different than illustrated to inhibit the damper 65 from rotating about the pivot axis 30 relative to the upright portion 50. For example, the keyed arrangement of the tab 85 and the notch 90 can include a different geometry and/or can be positioned at different locations on the damper 65 and upright portion 50. In some embodiments, the tab 85 (e.g., a rectangular key) can be diametrically located on the end of the damper 65 adjacent the first shaft 70 and/or the second shaft 75. In further embodiments, the damper 65 can include the notch 90 and the upright portion 50 can include the tab 85.

With continued reference to FIG. 2, the hinge post 25*a* also includes a bushing or slider 95 (e.g., a cap) having a central recess with opposing inner flat surfaces sized to receive corresponding flat surfaces of the first shaft 70 to inhibit relative rotation between the slider 95 and the first shaft 70. In other embodiments, the slider 95 can be fixed to the first shaft 70 in different ways (e.g., adhesive, fasteners, different geometrical configurations, etc.). For example, the first shaft 70 can be cylindrical (omitting the flat surfaces) to be received within a cylindrical central recess of the slider 95 to create a friction fit therebetween.

As shown in FIGS. 3 and 4, the slider 95 of the first hinge post 25*a* is received within an elongate slot 100 of a first mount 112 of the toilet seat 15. The first mount 112 enables the toilet seat 15 to be coupled to the first hinge post 25*a*. With reference to FIGS. 2-4, the illustrated slider 95 includes outer flat surfaces 105 that interface with an interior wall 110 defining the elongate slot 100. As such, the slider 95 is inhibited from rotating within the elongate slot 100, but rather, the slider 95 is freely moveable along a longitudinal axis 115 of the elongate slot 100. As best shown in FIG. 4, the longitudinal axis 115 of the elongate slot 100 is oriented vertically when the toilet seat 15 is in the lowered position. In other words, the longitudinal axis 115 is substantially perpendicular to a support surface 120 of the toilet bowl 35 that supports the hinge posts 25*a*, 25*b* when the toilet seat 15 is in the lowered position. The longitudinal axis 115 is also perpendicular to the pivot axis 30. In the illustrated embodiment, the longitudinal axis 115 intersects the pivot axis 30. In other embodiments, the longitudinal axis 115 may be offset from the pivot axis 30. The illustrated slider 95 is manufactured from plastic, similar to the toilet seat 15, reducing wear between the slider 95 and the elongate slot 100 during repeated use. In other embodiments, the slider 95 can be omitted such that the first shaft 70 is received within the elongate slot 100 to interface with the interior wall 110 and inhibit relative rotation of the first shaft 70 and the toilet seat 15. As also shown in FIG. 3, the second shaft 75 of the first hinge post 25*a* is coupled to the toilet lid 20 for the toilet lid 20 to rotate with the second shaft 75 about the pivot axis 30.

With continued reference to FIG. 3, the slow-close mechanisms 55 of the first and second hinge posts 25*a*, 25*b* are oriented in the same way along the pivot axis 30. As such, the first and second hinge posts 25*a*, 25*b* differ in that the first shaft 70 of the first hinge post 25*a* is coupled to the slider 95 and the second shaft 75 of the first hinge post 25*a* is coupled to the toilet lid 20, whereas the first shaft 70 of the second hinge post 25*b* is coupled to the toilet lid 20 and the second shaft 75 of the second hinge post 25*b* is coupled to the slider 95. As such, the slider 95 of the second hinge post 25*b* is received within a second mount 114 of the toilet seat 15 that defines the other elongate slot 100. The second mount 114 enables the toilet seat 15 to be coupled to the second hinge post 25*b*. The illustrated slow-close mechanisms 55 are oriented in the same way for the dampers 65 to cooperate and control movement of the toilet seat 15 and/or the toilet lid 20 when moving from the raised position to the lowered position. In particular, the dampers 65 control relative movement of the first and second shafts 70, 75 in a first direction, and allow free relative movement of the first and second shafts 70, 75 in a second direction. Accordingly, the dampers 65 of the first and second hinge posts 25*a*, 25*b* cooperate to inhibit the toilet seat 15 and/or the toilet lid 20 from slamming down onto the toilet bowl 35 from the raised position (e.g., the slow-close mechanisms 55 slow down movement of the toilet seat 15 and/or the toilet lid 20 free falling from the raised position). The dampers 65 of the first and second hinge posts 25*a*, 25*b* also allow free movement of the toilet seat 15 and/or the toilet lid 20 when being raised from the lowered position.

Figure 5:
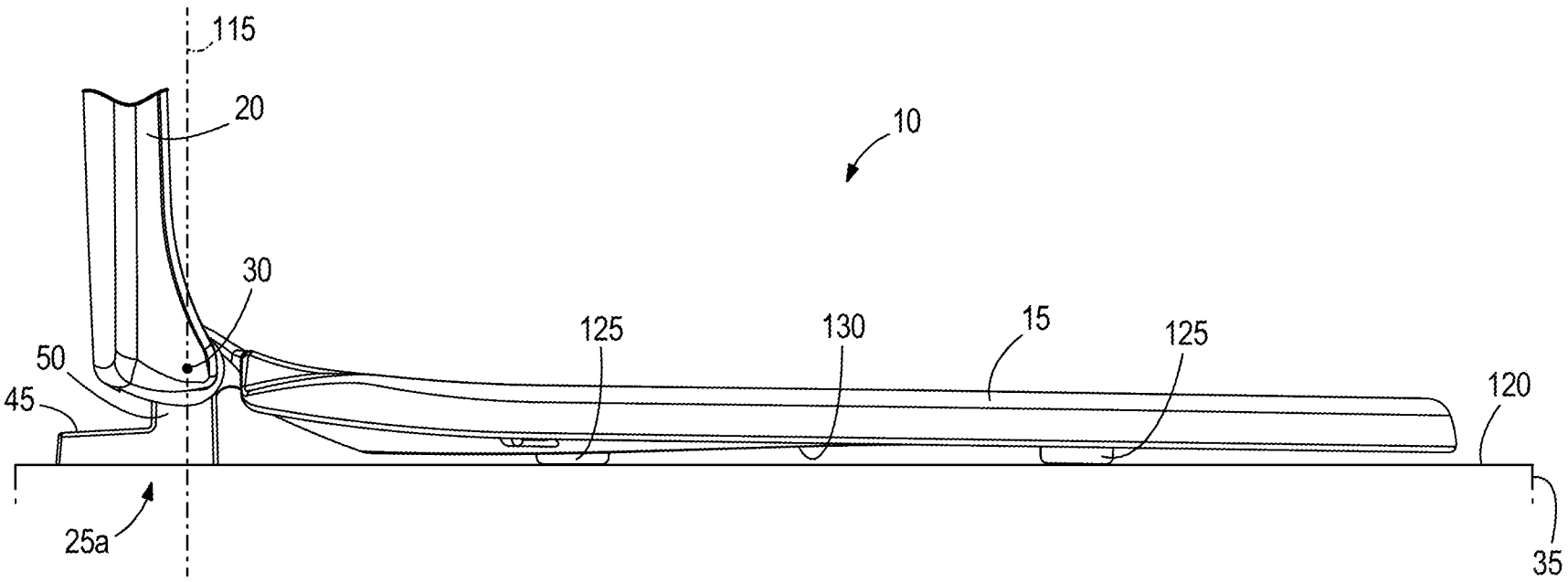
FIG. 5 is a side view of the toilet seat assembly when the toilet seat is in the lowered position and the toilet lid is in an open position.

With reference to FIG. 5, the toilet seat 15 includes load sensors 125 (e.g., ballistocardiogram sensors) coupled to a bottom surface 130 of the toilet seat 15 that engage the support surface 120 of the toilet bowl 35 when the toilet seat 15 is in the lowered position. The load sensors 125 are operable to measure at least a portion of the user's weight and/or a change in the user's weight while they sit on the toilet seat 15. The illustrated floating hinge posts 25*a*, 25*b* are operable to allow for linear movement between the toilet seat 15 and the hinge posts 25*a*, 25*b*/toilet bowl 35 along the longitudinal axes 115 such that the hinge posts 25*a*, 25*b* do not disrupt weight transfer from the user to the load sensors 125. In particular, when the user sits on the toilet seat 15, the toilet seat 15 will compress slightly under the weight of the user. In a conventional design where the toilet seat is only pivotably coupled to the hinge posts, the hinge posts will absorb some of the user's weight, potentially creating an inaccurate weight measurement from the load sensors 125. In the illustrated embodiment, the toilet seat 15 will linearly move relative to the hinge posts 25*a*, 25*b* (e.g., the sliders 95 move within the elongate slots 100 along the longitudinal axes 115) when the user sits on the toilet seat 15. Accordingly, the hinge posts 25*a*, 25*b* do not absorb any weight of the user, and the load sensors 125 provide an accurate measurement of the user's weight/change in weight. For example, the illustrated hinge posts 25*a*, 25*b* increase the accuracy of the load sensors 125 if, in one embodiment, the load sensors 125 function to sense ballistocardiogram properties of the user's heart while sitting on the toilet seat 15.

When the toilet seat 15 is in the lowered position, the slider 95 is generally in the middle of the elongate slot 100 (FIG. 4) providing enough space for the slider 95 to move within the elongate slot 100 in response to the user's weight against the toilet seat 15. However, as the toilet seat 15 is rotated about the pivot axis 30 into the raised position, the slider 95 can move within the elongate slot 100 and can contact ends 135 of the elongate slot 100. In the raised position, the longitudinal axis 115 of each elongate slot 100 is generally horizontal to the support surface 120. In other embodiments, the longitudinal axes 115 can be obliquely oriented relative to the support surface 120 when the toilet seat 15 is in the upright position.

Figure 6:
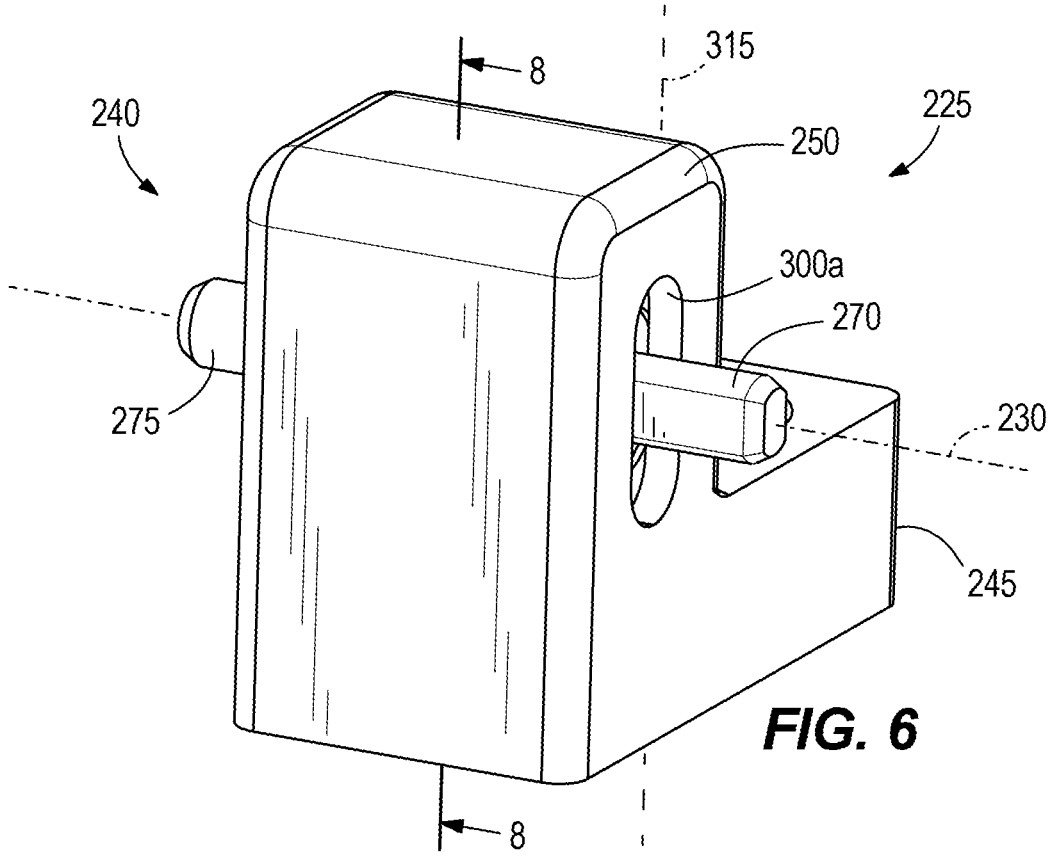
FIG. 6 is a perspective view of a hinge post according to another embodiment.
Figure 7:
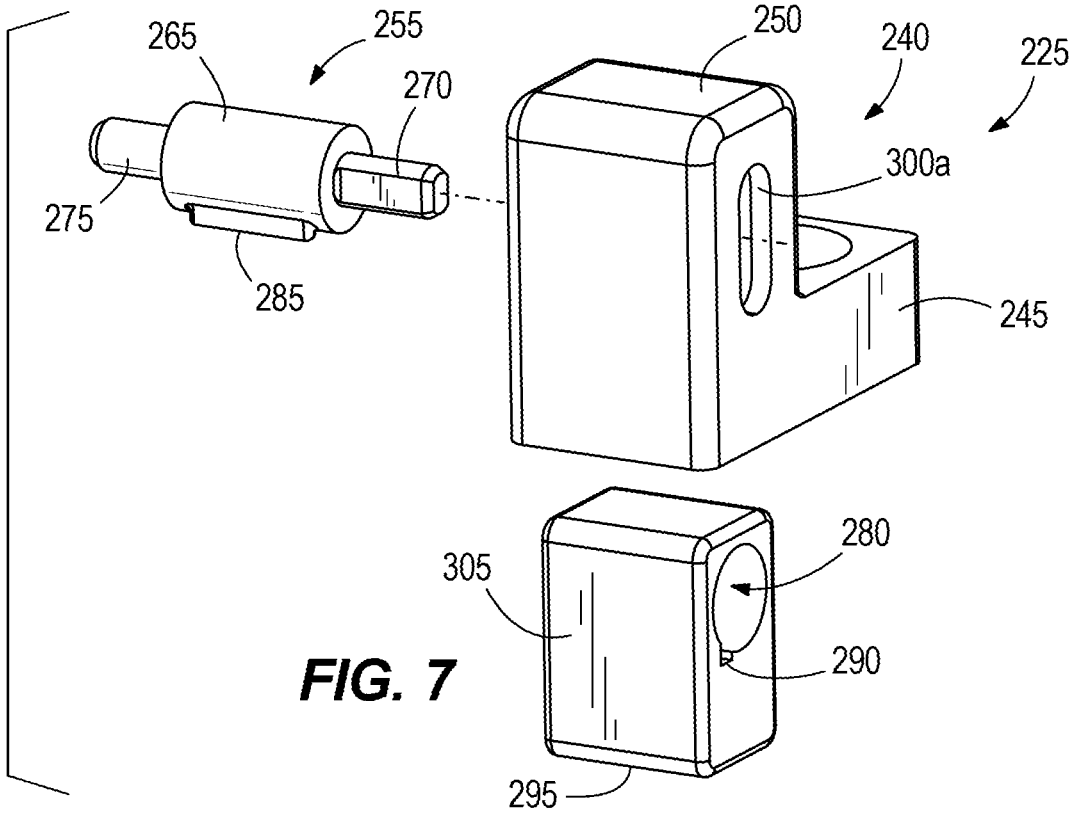
FIG. 7 is an exploded view of the hinge post of FIG. 6.
Figure 8:
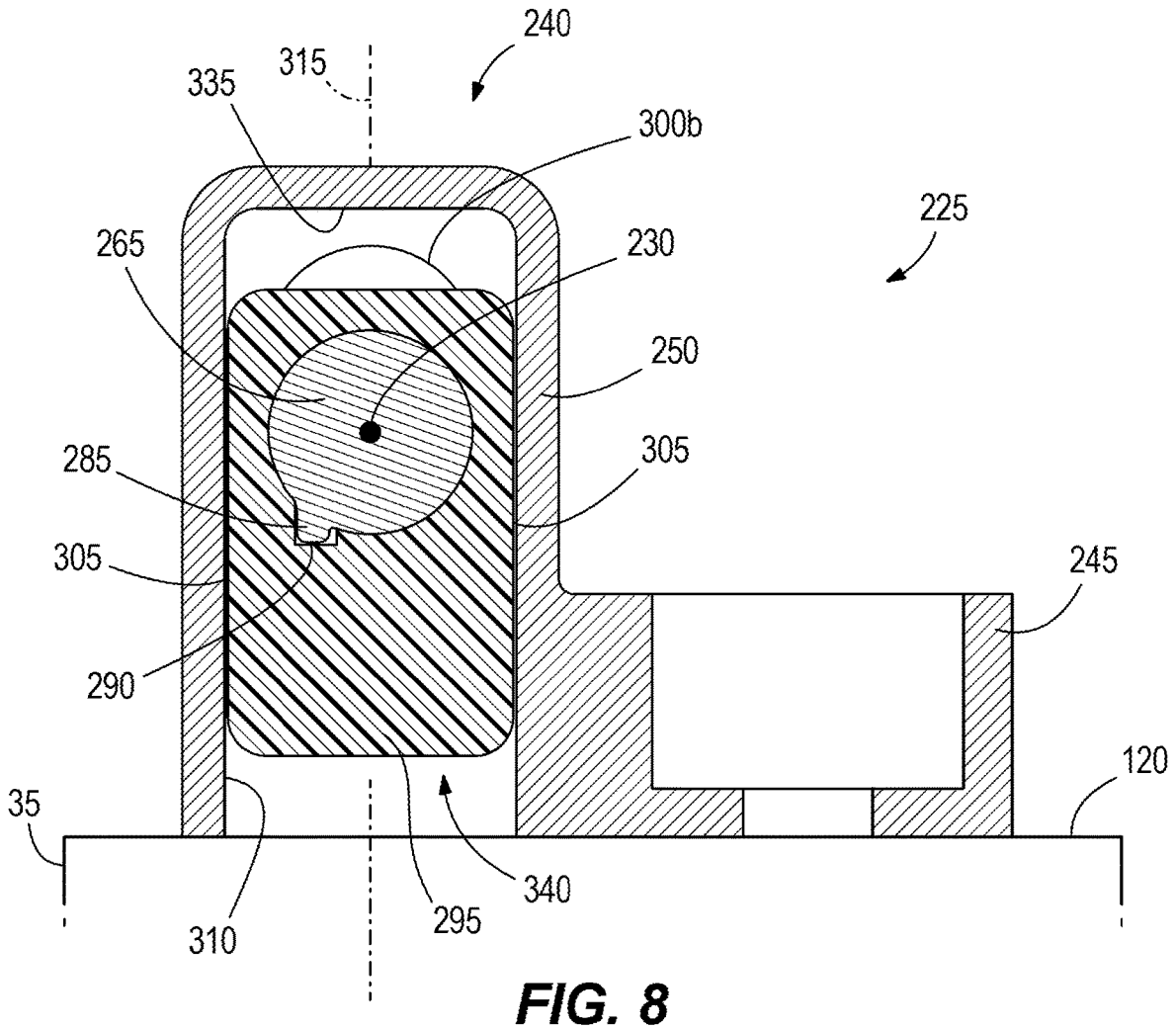
FIG. 8 is a cross sectional view of the hinge post taken along line 8-8 of FIG. 6.

FIGS. 6-8 illustrate a hinge post 225 according to another embodiment of the disclosure. The hinge post 225 is similar to the hinge post 25; therefore, similar components are designated with similar references numbers each incremented by 200. At least some differences and/or at least some similarities between the hinge posts 25, 225 will be discussed in detail below. In addition, components or features described with respect to the hinge post 225 are equally applicable to any other embodiments described herein.

One difference between the hinge posts 25, 225 is that the slow-close mechanisms 55 of the hinge post 25 remain linearly fixed to the corresponding body 40, whereas slow-close mechanisms 255 of the hinge post 225 linearly move relative to a corresponding body 240. In particular, each body 240 includes a mounting portion 245 and an upright portion 250. The upright portion 250 includes an internal channel 340 (FIG. 8) sized to receive a slider 295 (e.g., a block). The illustrated slider 295 includes two opposing outer flat surfaces 305 that interface with an interior wall 310 of the channel 340 to inhibit the slider 295 from rotating within the channel 340. The illustrated slow-close mechanism 255 includes a damper 265 having a first shaft 270 and a second shaft 275. The damper 265 also includes a tab 285 that is received within a notch 290 of a bore 280 of the slider 295. With reference to FIGS. 6-8, the first and second shafts 270, 275 extend through elongate slots 300*a*, 300*b* of the upright portion 250. The elongate slots 300*a*, 300*b* each include a longitudinal axis 315 perpendicular to the support surface 120 (FIG. 8). As the elongate slots 300*a*, 300*b* are formed in the upright portion 250, each longitudinal axis 315 is fixed relative to the body 240 and the toilet bowl 35.

In one embodiment, the toilet seat 15 is fixedly coupled to the first shaft 270 and the toilet lid 20 is fixedly coupled to the second shaft 275 of one hinge post 225. When the toilet seat 15 is in the lowered position, the slider 295 is generally in the middle of the channel 340 (FIG. 8), and the shafts 270, 275 are generally in the middle of the corresponding slot 300*a*, 300*b* (FIG. 6) providing enough space for the toilet seat 15 to linearly move when the user sits on the toilet seat 15. Accordingly, none of the weight of the user is absorbed by the floating hinge posts 225 and the load sensors 125 can accurately measure the weight/weight change of the user. As the toilet seat 15 is rotated about the pivot axis 230 into the raised position, the slider 295 can move within the channel 340 and contact an end 335 of the channel 340 or the support surface 120 of the toilet bowl 35 (FIG. 8). As a result, the damper 265 of each hinge post 225—and ultimately the pivot axis 230—can linearly move relative to the body 240 as the toilet seat 15 moves between the lowered position and the raised position.

FIGS. 9-12 illustrate a toilet seat assembly 410 according to another embodiment of the disclosure. The toilet seat assembly 410 is similar to the toilet seat assembly 10; therefore, similar components are designated with similar references numbers each incremented by 400. At least some differences and/or at least some similarities between the toilet seat assemblies 10, 410 will be discussed in detail below. In addition, components or features described with respect to the toilet seat assembly 410 are equally applicable to any other embodiments described herein.

Figure 9:
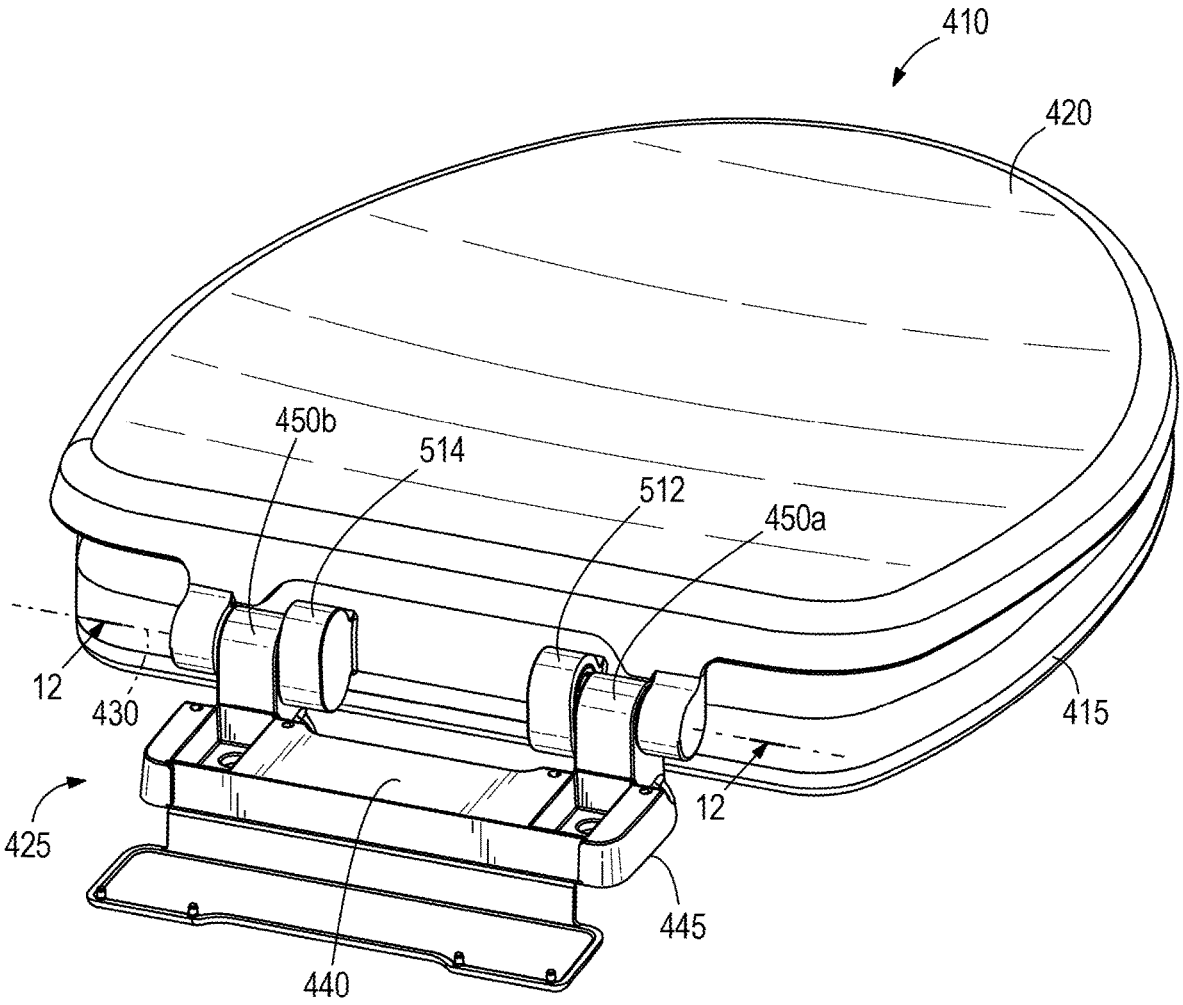
FIG. 9 is a perspective view of a toilet seat assembly including a toilet seat and a toilet lid pivotably coupled to a hinge post according to yet another embodiment.

The toilet seat assembly 410 includes a toilet seat 415 having the load sensors 125 and a toilet lid 420 pivotably coupled to a hinge post 425 about a pivot axis 430 (FIG. 9). The illustrated hinge post 425 includes a body 440 having a mounting portion 445 and upright portions 450*a*, 450*b*. In other embodiments, the hinge post 425 can be separated into two hinge posts each including a mounting portion and an upright portion (similar to the hinge posts 25*a*, 25*b* shown in FIG. 3). However, the single hinge post 425 provides better alignment of the upright portions 450*a*, 450*b* along the pivot axis 430 than the hinge posts 25*a*, 25*b* (e.g., misalignment can occur when the hinge posts 25*a*, 25*b* are secured to the toilet bowl 35). In other embodiments, each upright portion 450*a*, 450*b* can include the hinge post 225 (FIG. 6).

Figure 10:
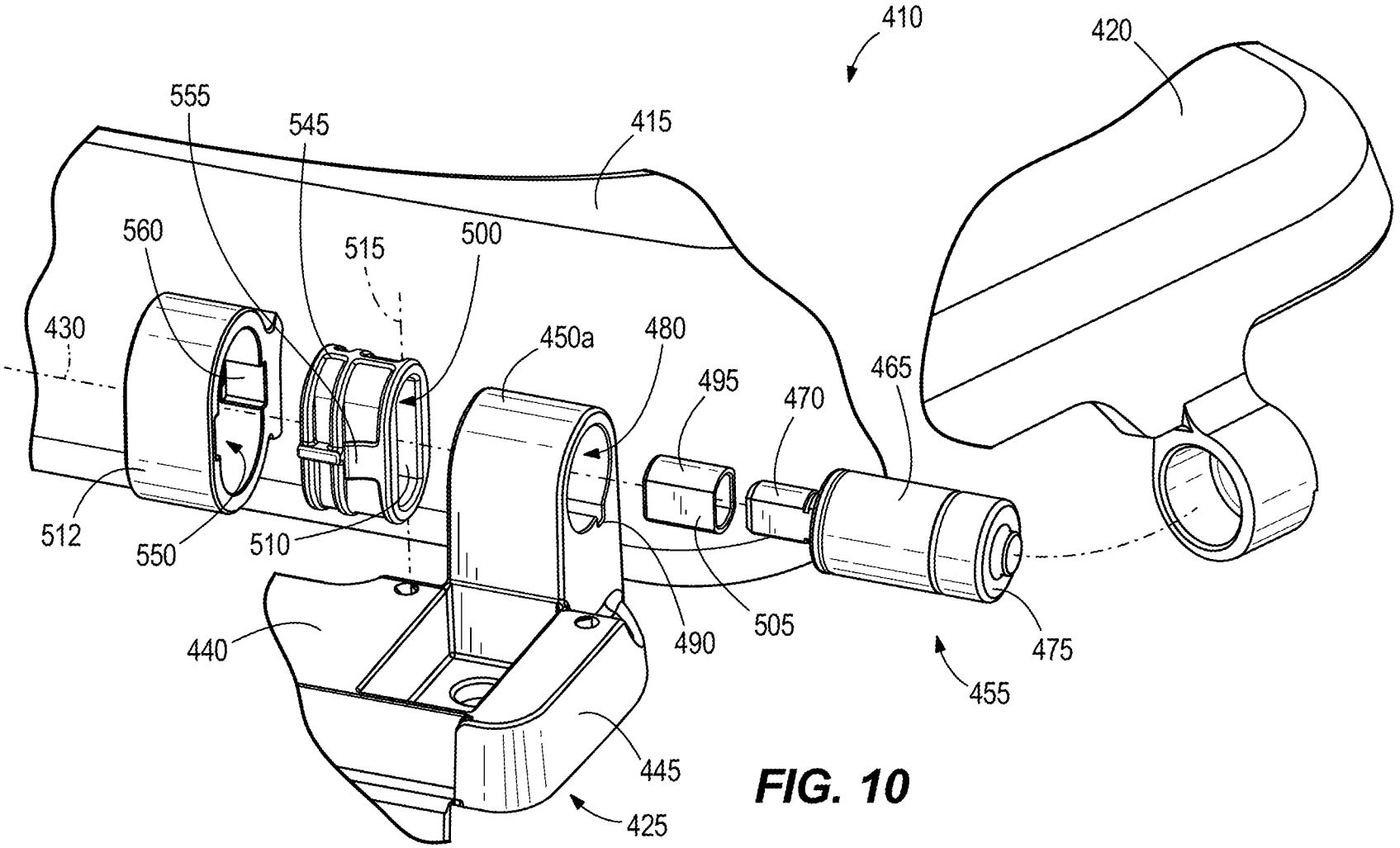
FIG. 10 is an exploded view of a portion of the toilet seat assembly of FIG. 9.
Figure 11:
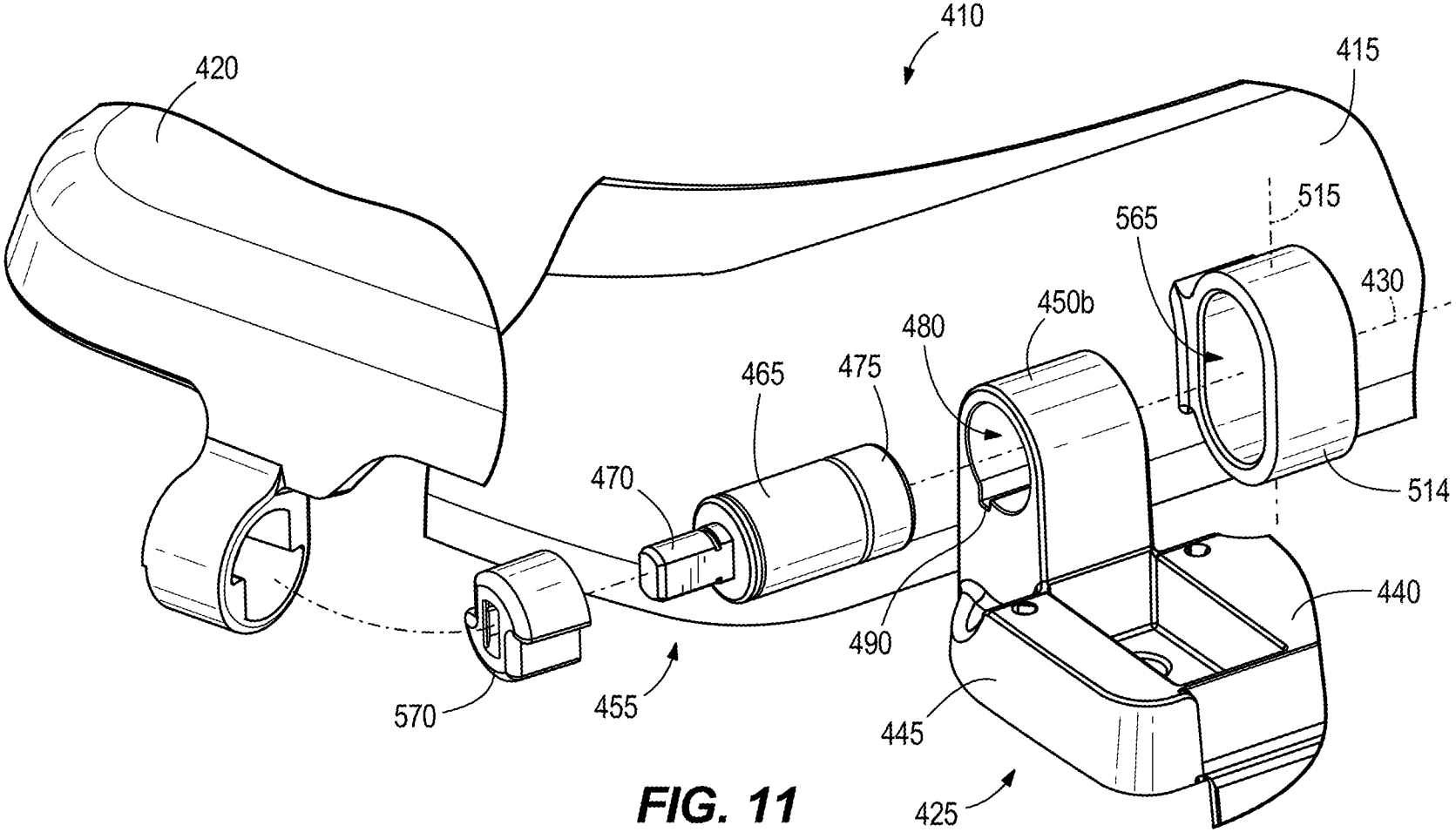
FIG. 11 is an exploded view of another portion of the toilet seat assembly of FIG. 9.

With reference to FIGS. 10 and 11, each of the upright portions 450*a*, 450*b* supports a slow-close mechanism 455 that includes a damper 465 received within a bore 480, a first shaft 470, and a second shaft or end portion 475. The damper 465 includes a tab (similar to the tab 85) that engages a notch 490 of the bore 480. As shown in FIG. 10, a slider 495 is coupled to the first shaft 470 and is received within an elongate slot 500 of a plug or insert 545. In particular, outer flat surfaces 505 of the slider 495 interface with an interior wall 510 of the insert 545. As such, the slider 495 is inhibited from rotating relative to the insert 545, but rather, the slider 495 is freely moveable along a longitudinal axis 515 of the elongate slot 500. In other embodiments, the slider 495 can be omitted such that the first shaft 470 directly engages the interior wall 510 of the insert 545. The insert 545 is received within a through aperture 550 defined by a first mount 512 of the toilet seat 415. In particular, the insert 545 is first inserted into an inboard side of the aperture 550 to then slide toward an outboard side of the aperture 550 and the first upright portion 450*a*. The insert 545 is inhibited from moving out of the aperture 550 (e.g., in a direction away from the first upright portion 450*a*) by protrusions 555 of the insert 545 (only one protrusion 555 is shown in FIG. 10) being received within recesses 560 of the first mount 512 (only one recess 560 is shown in FIG. 10). Stated another way, the insert 545 can be snapped in place within the aperture 550. In other embodiments, the protrusions 555 can be formed on the first mount 512, and the recesses 560 can be formed on the insert 545. In further embodiments, the insert 545 can be first inserted into the aperture 550 from the outboard side of the aperture 550 to then slide toward the inboard side of the aperture 550. In yet further embodiments, the protrusions 555 and the recesses 560 can be omitted such that the insert 545 is secured within the aperture 550 by, for example, friction fit, adhesives, etc. In some embodiments, the insert 545 and the slider 495 can be manufactured from similar plastic reducing wear between the slider 495 and the insert 545 during repeated use. As also shown in FIG. 10, the second shaft 475 is coupled to the toilet lid 420.

Figure 12:
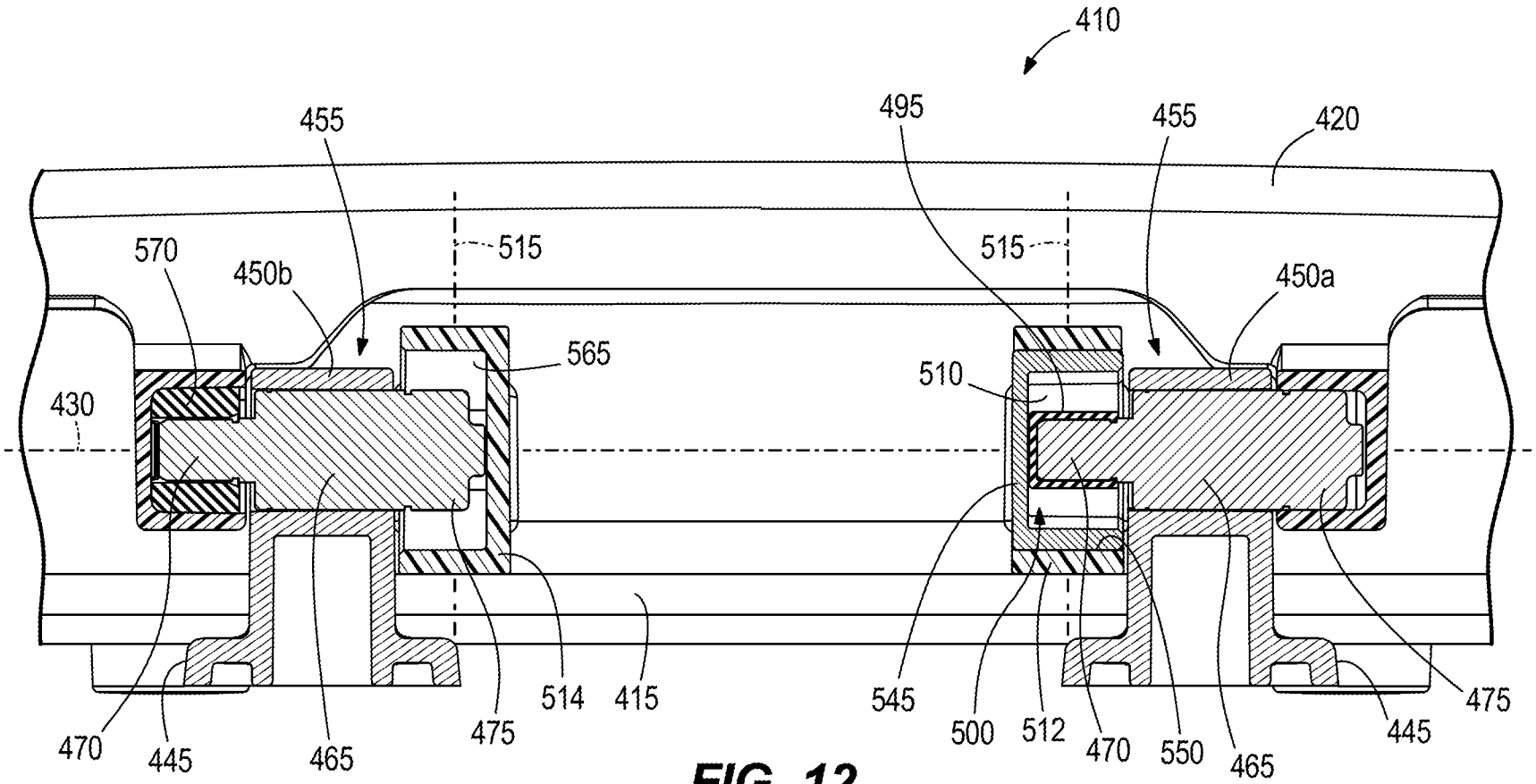
FIG. 12 is a cross sectional view of the toilet seat assembly of FIG. 9 taken along a pivot axis of the toilet seat when the toilet seat is in a lowered position and the toilet lid is in a closed position.

With reference to FIGS. 10 and 11, the slow-close mechanisms 455 are oriented in the same way along the longitudinal axis 430. Accordingly, the dampers 465 of the hinge post 425 cooperate to inhibit the toilet seat 415 and/or the toilet lid 420 from slamming down onto the toilet bowl 35 from the raised position. The first shaft 470 associated with the first upright portion 450*a* is received within the first mount 512 and the second shaft 475 associated with the first upright portion 450*a* is coupled to the toilet lid 420, whereas the first shaft 470 associated with the second upright portion 450*b* is coupled to the toilet lid 420 and the second shaft 475 associated with the second upright portion 450*b* is received within a second mount 514 of the toilet seat 415. Specifically, the second shaft 475 is received within an elongate aperture 565 of the second mount 514 for the second shaft 475 to be freely moveable along a longitudinal axis 515 of the aperture 565 (e.g., up and down as viewed in FIG. 12). The aperture 565 of the second mount 514 differs from the aperture 550 of the first mount 512 in that the aperture 565 is not a through aperture (FIG. 12). As also shown in FIG. 11, the first shaft 470 is coupled to the toilet lid 420 via an anti-rotation member 570 for the toilet lid 420 to rotate with the first shaft 470 about the pivot axis 430. In other embodiments, the first shaft 470 can be directly attached to the toilet lid 420.

In the illustrated embodiment, the toilet seat assembly 410 includes one insert 545 received within the through aperture 550 of the first mount 512. In other embodiments, the toilet seat assembly 410 can include another insert 545 received within the other aperture 565 of the second mount 514 to interface with the second shaft 475 associated with the second upright portion 450*b*. In further embodiments, the both apertures 550, 565 can be through apertures, none of the apertures 550, 565 can be through apertures, or one of the apertures 550, 565 can be a through aperture.

During assembly of the toilet seat assembly 410, the second upright portion 450*b* is coupled to the toilet seat 415 and the toilet lid 420 before the first upright portion 450*a*. For example, one slow-close mechanism 455 (FIG. 11) is inserted into the bore 480 of the second upright portion 450*b* for the second shaft 475 to be received within the second mount 514 and the first shaft 470 to be coupled to the toilet lid 420. With reference to FIG. 10, the toilet lid 420 is then aligned with the bore 480 of the first upright portion 450*a* such the other slow-close mechanism 455 is inserted into the bore 480 for the second shaft 475 to couple with the toilet lid 420. In some embodiments, the aperture 550 can be aligned with the bore 480 for the slow-close mechanism 455 to be inserted through the aperture 550 to then be received within the bore 480 of the first upright portion 450*a*. As a result, the slider 495 is positioned within the aperture 550. The insert 545 is then inserted into the first mount 512 for the wall 510 of the insert 545 to interface with the flats 505 of the slider 495. The insert 545 is secured within the first mount 512 by the protrusions 555 engaging the recesses 560. In other words, the aperture 550 provides easy assembly of the toilet seat assembly 410 by allowing the slow-close mechanism 455 and/or the insert 545 to be inserted through the aperture 550 once the aperture 550 is aligned with the bore 480 of the first upright portion 450*a*. In other embodiments, the toilet seat assembly 410 can be assembled in a different way not explicitly disclosed herein.

The illustrated floating hinge posts 425 is operable to allow for linear movement between the toilet seat 415 and the hinge post 425/toilet bowl 35 along the longitudinal axes 515 such that the hinge post 425 does not disrupt weight transfer from the user to the load sensors 125. In particular, when the user sits on the toilet seat 415, the toilet seat 415 will compress slightly under the weight of the user. In the illustrated embodiment, the toilet seat 415 will linearly move relative to the hinge post 425 (e.g., the slider 495 and the second shaft 475 move within the insert 545 and the second mount 514, respectively, along the longitudinal axes 515) when the user sits on the toilet seat 415. Accordingly, the hinge post 425 does not absorb any weight of the user, and the load sensors 125 provide an accurate measurement of the user's weight/change in weight.

Although the disclosure has been described in detail with reference to certain preferred embodiments, variations and modifications exist within the scope and spirit of one or more independent aspects of the disclosure as described. Various features and advantages of the disclosure are set forth in the following claims.

The invention claimed is:

1. A toilet seat assembly comprising:

a hinge post configured to be coupled to a toilet bowl;

a toilet seat configured to move between a raised position and a lowered position about a pivot axis relative to the toilet bowl; and a slow-close member coupled to the hinge post such that the pivot axis remains stationary relative to the hinge post, the slow-close member also coupled to the toilet seat such that the toilet seat is moveable along a longitudinal axis relative to the hinge post while the toilet seat is coupled to and inhibited from being removed from the hinge post, the slow-close member controlling movement of the toilet seat about the pivot axis when the toilet seat moves from the raised position to the lowered position.

2. The toilet seat assembly of claim 1, wherein the toilet seat includes a load sensor configured to sense a load on the toilet seat when in the lowered position, and wherein the toilet seat is moveable along the longitudinal axis such that the hinge post does not disrupt transfer of the load to the load sensor.

3. The toilet seat assembly of claim 1, wherein the hinge post is a first hinge post and the slow-close member is a first slow-close member, wherein the toilet seat assembly further comprises a second slow-close member coupled to a second hinge post, and wherein the second slow-close member cooperates with the first slow-close member for the toilet seat to be moveable along the longitudinal axis and to control the movement of the toilet seat about the pivot axis.

4. The toilet seat assembly of claim 1, wherein the slow-close member is a first slow-close member, wherein the hinge post includes a first upright portion and a second upright portion, wherein the first slow-close member is coupled to the first upright portion and a second slow-close member is coupled to the second upright portion, and wherein the second slow-close member cooperates with the first slow-close member for the toilet seat to be moveable along the longitudinal axis and to control the movement of the toilet seat about the pivot axis.

5. The toilet seat assembly of claim 1, wherein the toilet seat includes an elongate aperture defining the longitudinal axis, wherein the slow-close member includes a shaft received within the elongate aperture, and wherein the shaft is moveable within the elongate aperture along the longitudinal axis.

6. The toilet seat assembly of claim 5, further comprising a slider coupled to the shaft, wherein the slider includes an outer flat surface engageable with an inner wall of the elongate aperture to guide movement of the toilet seat along the longitudinal axis.

7. The toilet seat assembly of claim 5, further comprising an insert received within the elongate aperture of the toilet seat, wherein the shaft of the slow-close member is moveable within the insert along the longitudinal axis.

8. The toilet seat assembly of claim 1, wherein the longitudinal axis is perpendicular to the pivot axis.

9. A toilet seat assembly comprising:

a hinge post configured to be coupled to a toilet bowl;

a toilet seat configured to move between a raised position and a lowered position about a pivot axis relative to the toilet bowl; and a slow-close member coupled between the hinge post and the toilet seat such that the toilet seat is moveable along a longitudinal axis relative to the hinge post while the toilet seat is coupled to and inhibited from being removed from the hinge post, the slow-close member controlling movement of the toilet seat about the pivot axis when the toilet seat moves from the raised position to the lowered position.

10. The toilet seat assembly of claim 9, wherein the toilet seat includes a load sensor configured to sense a load on the toilet seat when in the lowered position, and wherein the toilet seat is moveable along the longitudinal axis such that the hinge post does not disrupt transfer of the load to the load sensor.

11. The toilet seat assembly of claim 9, wherein the hinge post is a first hinge post and the slow-close member is a first slow-close member, wherein the toilet seat assembly further comprises a second slow-close member coupled to a second hinge post, and wherein the second slow-close member cooperates with the first slow-close member for the toilet seat to be moveable along the longitudinal axis and to control the movement of the toilet seat about the pivot axis.

12. The toilet seat assembly of claim 9, wherein the slow-close member is a first slow-close member, wherein the hinge post includes a first upright portion and a second upright portion, wherein the first slow-close member is coupled to the first upright portion and a second slow-close member is coupled to the second upright portion, and wherein the second slow-close member cooperates with the first slow-close member for the toilet seat to be moveable along the longitudinal axis and to control the movement of the toilet seat about the pivot axis.

13. The toilet seat assembly of claim 9, wherein the slow-close member is coupled to the hinge post such that the pivot axis remains stationary relative to the hinge post.

14. The toilet seat assembly of claim 9, wherein the slow-close member is coupled to the hinge post such that the pivot axis is moveable along the longitudinal axis relative to the hinge post.

15. The toilet seat assembly of claim 9, further comprising a toilet lid moveable between a raised position and a lowered position about the pivot axis, wherein the slow-close member is coupled to the toilet lid to control movement of the toilet lid about the pivot axis when the toilet lid moves from the raised position to the lowered position.

* * * * *